United States Patent [19]

Katsurai

[11] 4,151,498

[45] Apr. 24, 1979

[54] COMBINED SUPERCONDUCTING COIL

[76] Inventor: Makoto Katsurai, 3-36-15, Nishihara, Shibuya-ku, Tokyo 151, Japan

[21] Appl. No.: 810,683

[22] Filed: Jun. 27, 1977

[30] Foreign Application Priority Data

Jul. 5, 1976 [JP] Japan ..... 51-079031

[51] Int. Cl.[2] ..... H01F 7/22

[52] U.S. Cl. ..... 335/216; 174/126 S

[58] Field of Search ..... 335/216; 174/126 S, 174/126 C, 126 CP; 336/DIG. 1

[56] References Cited

U.S. PATENT DOCUMENTS

| | | | |
|---|---|---|---|
| 3,129,359 | 4/1964 | Kunzler | 335/216 X |
| 3,283,277 | 11/1966 | Hulm et al. | 335/216 |

OTHER PUBLICATIONS

IEEE Transaction on Nuclear Science, Aug. 1971, vol. NS-18, No. 4, pp. 265-272, K. R. Efferson et al.

Plasma Physics & Controlled Nuclear Fusion Research, 1974, IAEA Vienna, 1975, vol. III, pp. 535-549, K. Sato et al.

IEEE Transaction on Magnetics, vol. Mag-11, No. 2, Mar. 1975, pp. 524-527, J. Kaugerts et al.

IEEE Transaction on Magnetics, vol. Mag-11, Mar. 1975, pp. 519-520, P. A. Cheremnykh et al.

*Primary Examiner*—George Harris

*Attorney, Agent, or Firm*—Spencer & Kaye

[57] ABSTRACT

A combined superconducting coil comprising a coil winding formed by an alloy type composite superconducting wire for generating a strong magnetic field exceeding a critical value in at least one part of the respective turns of the coil winding when an exciting current is applied to the coil winding, a plurality of partial by-pass wires formed by a compound type composite superconducting wire and arranged along and in contact with the coil winding so that the partial by-pass wires form by-passes for the exciting current along portions of the coil winding where the strong magnetic field exceeds the critical value, and a plurality of flow passages for circulating extremely low temperature helium between the respective turns of the coil winding so that the helium is in direct contact with at least one of the coil winding and the partial by-pass wires. The length of each partial by-pass wire is so selected that both ends thereof extend beyond said portion of the coil winding. The superconducting material of the partial by-pass wire has such a high critical magnetic field as maintaining superconductivity even in the excessively strong magnetic field. The combined superconducting coil according to this invention has a high effective working magnetic field and can be easily manufactured by combining alloy type composite superconducting wire with compound type composite superconducting wire.

16 Claims, 9 Drawing Figures

COMBINED SUPERCONDUCTING COIL

BACKGROUND OF THE INVENTION

This invention generally relates to a large size magnetic coil for generating strong magnetic field, and more particularly to a combined superconducting coil having a high effective magnetic field, the coil and wires thereof being easily manufactured.

Superconducting magnets for generating strong magnetic field are essential for the plasma confining device of nuclear fusion and for the magnetohydrodynamic (MHD) power generator. At present, use is mostly made of a niobium-titanium alloy (NbTi) wire as the superconducting coil winding used for the magnets. More specifically, a so-called stabilized coil wire having a composite structure, wherein a plurality of fine or thin wires made of niobium-titanium alloy are embedded in a copper or aluminum matrix, has been practically used. This type of coil winding is referred to as "alloy type composite superconducting winding". This winding is fit for wire drawing process, so that long wires can be manufactured in large quantities by this process.

Ordinarily, a superconducting wire kept at a temperature lower than the critical temperature (or transition temperature) will lose its superconductivity under application of a magnetic field higher than a certain strength, and the maximum value of the magnetic field capable of maintaining the superconductivity of the wire is referred to as a critical magnetic field. In general, the critical magnetic field decreases according to the increase of the temperature of the wire and the increase of the current flowing therethrough. In the case of NbTi wire, if no current flow therethrough, this value is in a range of approximately from 10 to 12 T (wherein T means Tesla or $Wb/m^2$) at the temperature of liquid helium; and when such a wire is actually wound into a large size coil for practical use and a rated current flows therethrough, it is considered that the critical magnetic field becomes approximately 8 T which corresponds to the maximum allowable value applicable to the winding.

On the other hand, when a magnet is composed of a combination of the superconducting coils, the effective working magnetic field, i.e. magnetic field effectively usable for the purpose of the superconducting magnet cannot be enhanced to the critical magnetic field. The reason follows; the maximum magnetic field actually applied to the winding itself is ordinarily greater than the effective working magnetic field because of the geometrical effect, and when this actually applied maximum magnetic field exceeds the critical magnetic field, the superconductivity of the magnet collapses, so that the magnet can no longer operate as a superconducting magnet.

The above described feature will be described in more detail with respect to a plasma confining magnet used in nuclear fusion reactors.

As for a magnet used for confining plasma, torus magnet is typical. In a practical nuclear fusion reactor, this magnet is ordinarily made of superconducting coils. In this case, several tens of superconducting coils of circular or D-shaped configuration dipped in liquid helium are disposed around the toroidal shape plasma vessel for generating toroidal magnetic field. In the practical nuclear fusion reactor, there exist further magnetic fields generated by other coils, such as of poloidal magnet creating a magnetic field in the poloidal direction (the direction perpendicular to and running around the toroidal magnetic field) in addition to the magnet for generating the toroidal magnetic field, thus exhibiting a complicated distribution of the magnetic field which is applied to the superconducting coil windings. The maximum magnetic field applied to each of the coil windings disposed in the toroidal form appears locally in a region of the coil facing the central axis of the torus and on the inner surface of the coil. This maximum magnetic field amounts to 1.5 to 3 times the effective working magnetic field of the toroidal magnet, i.e. the magnetic field in the central part of the cross section of the plasma vessel. Accordingly, if NbTi wire is used for the superconducting coil winding, the effective working magnetic field is held at a lower value in a range of from 3 to 4 T.

There has been a strong demand for improving the effect of the magnetic field by generating higher effective working magnetic field not only in the nuclear fusion magnet but also in other superconducting magnets used for various purposes, and the development of superconducting wires for higher magnetic field, which have higher critical magnetic field values than the NbTi, has been pursued energetically. At present, winding wires having composite structures using intermetallic compounds, such as $Nb_3Sn$, $V_3Ga$, or the like (hereinafter referred to as "compound type materials"), are manufactured as the superconducting wires for higher magnetic field. While some of these wires have critical magnetic field values exceeding 20 T, the compound type wire materials are hard and brittle, so that these materials cannot be drawn into wires. Therefore, it is said that the compound type composite superconducting wire of long size can be hardly manufactured economically as in the case of the alloy type superconducting wire, and it is considered that large superconducting coil made of compound type composite superconducting wire is hardly developed economically in near future.

SUMMARY OF THE INVENTION

An object of the present invention is to provide a combined superconducting coil having a high effective working magnetic field.

Another object of the present invention is to provide a combined superconducting coil comprising composite superconducting wires of fully stabilized type.

Further object of the present invention is to provide a combined superconducting coil which can be easily manufactured by combining two kinds of composite superconducting wires.

According to the present invention, these objects can be achieved as follows. A plurality of partial by-pass wires formed by compound type composite superconducting wires for high magnetic field are arranged respectively in portions which are exposed to exceesively strong magnetic field (which portions correspond to a point to which the maximum magnetic field of the coil is applied and a vicinity region thereof where, under a rated operating condition, the strength of the magnetic field exceeds the critical magnetic field value) of a superconducting coil winding composed of alloy type composite superconducting wire in such a way that the partial by-pass wires extend along the coil winding in a tightly contacting relationship with the coil winding so that both ends of the partial by-pass wire extend beyond the portions of the coil winding which are exposed to the excessively strong magnetic field. In addition, a plurality of flow passages for circulating extremely low temperature helium are provided between the respective turns of the coil winding so that the helium is in direct contact with at least one of the coil winding and the partial by-pass wires.

With the above-mentioned object in mind, the following description, by way of nonlimiting embodiments, is given in conjunction with the following drawings.

DESCRIPTION OF THE PREFERRED EMBODIMENTS

Embodiments of a combined superconducting coil according to the present invention will now be described in detail with reference to the accompanying drawings.

Figure 1:
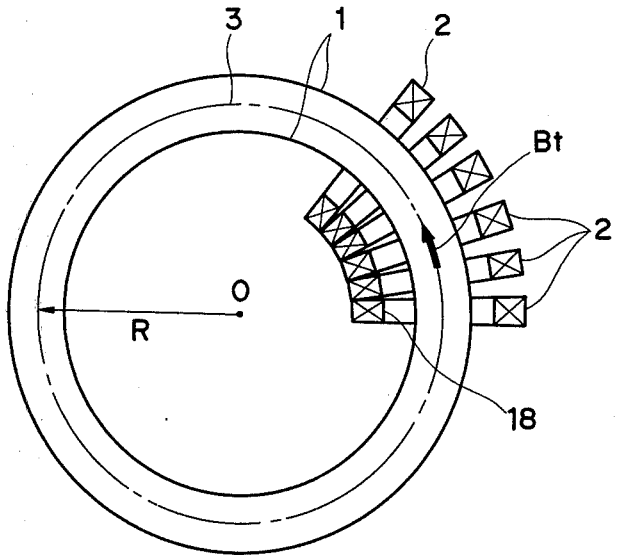
FIG. 1 is a sectional plan view of a toroidal magnet relating to the present invention.

In FIG. 1, reference numeral 1 designates a plasma vessel of toroidal form, along which a plurality of superconducting magnets 2 are arranged equidistantly and concentrically around a toroidal center line 3 of the plasma vessel 1. The toroidal center line 3 forms a circle having a major radius R. An exciting current as indicated by arrow 4 in FIG. 2 flows in the poloidal direction through each magnet 2, thereby producing a magnetic field Bt in a toroidal direction along the plasma vessel 1. The distribution of the magnetic field Bt in the major radial direction of the plasma vessel 1 is illustrated in FIG. 3, wherein a reference numeral 9 designates the effective working magnetic field, and a reference numeral 10 designates the maximum magnetic field. In a practical nuclear fusion reactor, the major radius R of the circle formed by the center line 3 of the plasma vessel 1 is in a range of from 8 to 18 m, whereas the inner diameter of the magnet 2 is in a range of from 4 to 8 m.

Figure 2:
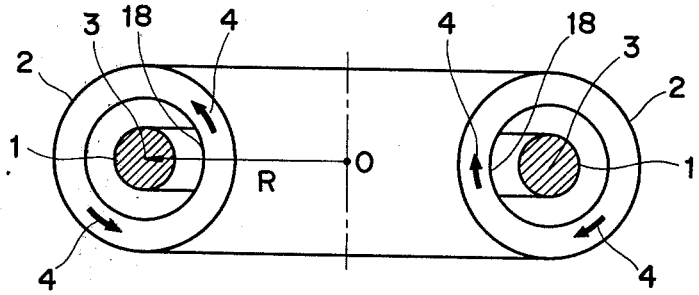
FIG. 2 is a cross-sectional view of the magnet shown in FIG. 1.
Figure 3:
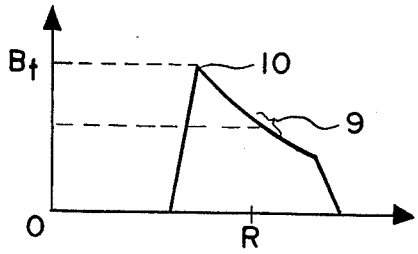
FIG. 3 is a graph illustrating a distribution of the toroidal magnetic field Bt with respect to a radial position of the toroidal magnet, corresponding to the position shown in FIG. 2.
Figure 4:
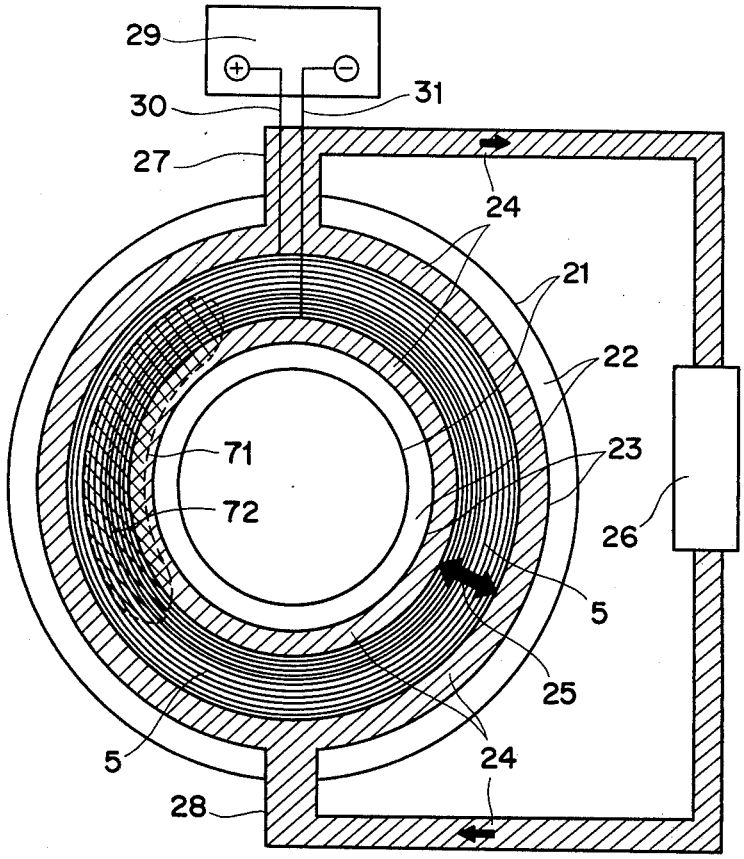
FIG. 4 is a schematic view showing one embodiment of the structure of a superconducting magnet formed by a combined superconducting coil according to the present invention.
Figure 5:
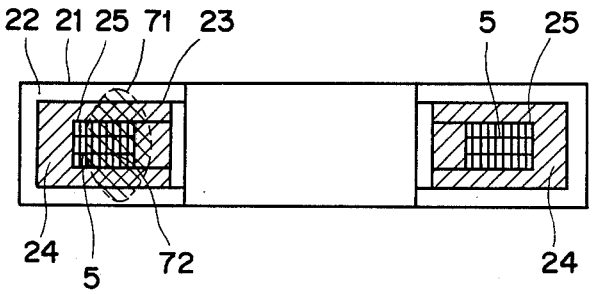
FIG. 5 is a cross sectional view of the magnet shown in FIG. 4.

While various configurations of the magnet 2 have been proposed, a circular configuration as shown in FIG. 2 will be considered here. FIGS. 4 and 5 illustrate the construction of the magnet 2, wherein reference numeral 21 designates a cryostat or a low temperature container having a helium containing vessel 23 which is disposed inside of insulating layers 22. A superconducting coil 25 is cooled by liquid helium 24 circulating through the helium containing vessel 23. The liquid helium 24 is forcedly circulated by a helium refrigerator 26 through a helium inlet port 28 and a helium outlet port 27 of the cryostat 21, so that the interior of the helium vessel 23 is maintained at an extremely low temperature, i.e. at about 4 K (degree Kelvin). A reference numeral 29 designates a d.c. power source for supplying the excitation current 4 through lead wires 30 and 31 to a coil winding 5 of the superconducting coil 25.

Figure 6:
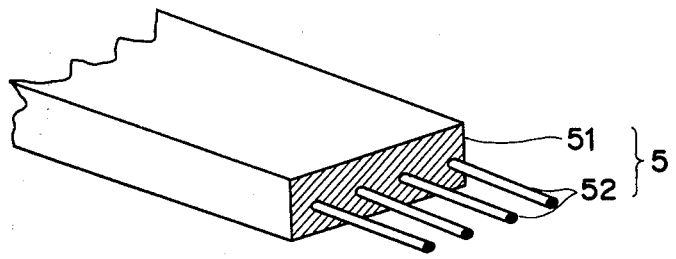
FIG. 6 is a perspective view showing a partial structure of a composite superconducting wire in FIG. 4.

The coil winding 5 usually has a construction as shown in FIG. 6, wherein a plurality of superconducting core wires 52 are embedded in a normally conducting matrix 51 made of copper or aluminum of high purity. When an excitation current of approximately 10,000 A flows through the coil winding 5, the coil winding 5 should have a width of approximately 3 to 5 cm and a thickness of approximately 1 cm. If necessary, the outer surface of the matrix 51 may be covered by an electrically insulating material. As shown in FIG. 5 which is a sectional view of the magnet shown in FIG. 4, the coil winding 5 is rigidly wound to form the superconducting coil 25 under application of a tension so that the coil winding 5 is not moved by an electromagnetic force or the like. During the winding procedure, spacers (not shown) are inserted at required positions between respective turns of the coil winding 5 so that flow passages for the liquid helium are formed in such a way that at least one side surface of the coil winding 5 directly contacts the liquid helium throughout substantially the entire length of the coil winding 5. It should be noted that a region 72 surrounded by a dotted line on boundary 71 in FIGS. 4 and 5 corresponds to the portion exposed to the excessively strong magnetic field. This region 72 also corresponds to an area in the vicinity of the point exposed to the maximum magnetic field on an internal surface 18 of each toroidal magnet 2 in FIGS. 1 and 2. In the superconducting coil according to the present invention, a magnetic field exceeding the critical magnetic field of the superconducting core wire 52 (FIG. 6) is applied to the region 72 of each superconducting coil 25 when the effective working magnetic field of the coil is maintained at a rated value, so that the region 72 is specifically referred to as "excessively strong magnetic field region".

The specific feature of the winding in the "excessively strong magnetic field region" 72 of the present invention is explained with reference to FIG. 7.

Figure 7:
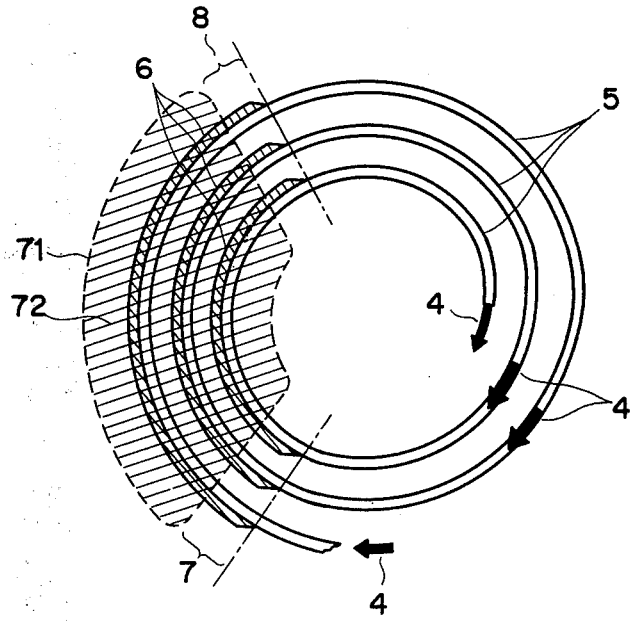
FIG. 7 is a schematic view showing one embodiment of the structure of partial by-pass wires provided in the combined superconducting coil in FIG. 4.

In FIG. 7, a part consisting of about three turns of the coil winding 5 of the coil 25 which passes through the excessively strong magnetic field region 72 is indicated in a loosened manner, while the parts such as spacers or reinforcing members against the electromagnetic forces are removed from the drawing of FIG. 7. A reference numeral 6 designates partial by-pass wires composed of a superconducting material different from that of the coil winding 5. A compound type composite superconducting wire which has a higher critical magnetic field is used as the partial by-pass wires 6. In the excessively strong magnetic field region 72 and also in end portions 7 and 8 contiguous thereto, a matrix 61 of each composite superconducting partial by-pass wire 6 is brought into tight contact with the matrix 51 of the coil winding 5, while the electrical insulating layers, if any, is removed from adjacent surfaces. Alternatively, the surfaces of the matrices 51 and 61 contacting each other may be soldered or bonded together by an intermediary of electrically conductive material. The partial by-pass wires 6 function to by-pass the exciting current during the operation of the magnet.

Figure 8:
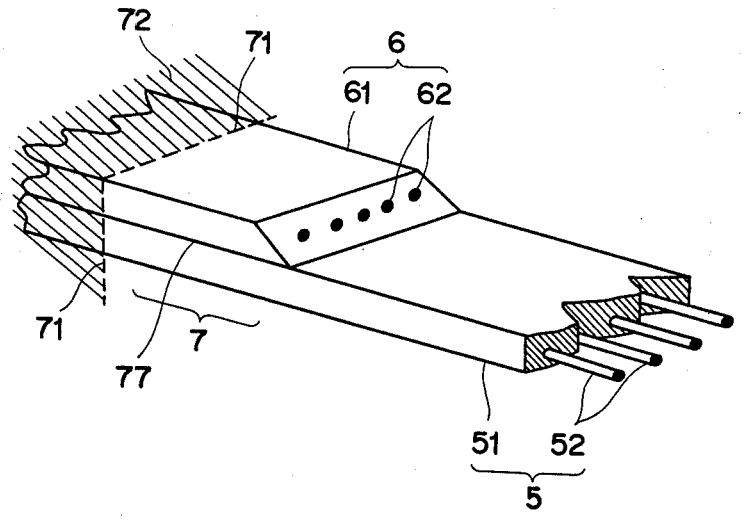
FIG. 8 is an enlarged view showing one end of one of the partial by-pass wires shown in FIG. 7.

The two end portions 7 and 8 of each partial by-pass wire 6 have structures similar to each other so that only the structure of the end portion 7 is explained by showing the end portion 7 in detail in FIG. 8. In FIG. 8, a part of the end portion 7 corresponding to one turn of the winding is shown in an enlarged manner. In FIG. 8, reference numeral 61 designates the matrix of the partial by-pass wire 6, and reference numeral 62 designates high magnetic field type superconducting wires embedded in the matrix 61. The length of the end portion 7 is selected in a range of from several tens centimeters to several meters. In the case where the partial by-pass wire 6 is made of a compound type composite wire, the core wires 62 are not necessarily limited to fine wires. Alternatively, use may be made of thin belts (compound type strip wires) which are embedded in the matrix 61 or applied onto the surface of the matrix 61. When the part of the winding shown in FIG. 7 is actually wound into a coil form, spacers or the like are inserted between the winding turns, whereby to provide helium passages around the turns. As a result, at least one of the surfaces of the two kinds of the composit superconducting wires 5 and 6 is brought into direct contact with the liquid helium. That is to say, a dip type cooling system for the magnet is employed here.

Operations of the superconducting coil according to the present invention will now be described in detail.

Both of the above described two kinds of composit superconducting wires, namely the coil winding 5 and the partial by-pass wires 6 which are provided in parallel to the coil windings 5 in the excessively strong magnetic field region 72 are required to be fully (or cryostatically) stabilized. This means that the ratio of the cross-sectional area of the matrix made of copper or aluminum to the cross-sectional area of the core wires is selected in a range of from 10 to several tens, having a greater quantity of the material of the matrix surrounding the core wires. Furthermore, in the case where the superconducting coil is formed by the fully stabilized windings, even if the superconductivity of the core wires is accidentally lost at some sections of the winding by any reason during the operation (in this case the resistance of the superconducting wires becomes higher than that of the matrix), the Joule heat (since the matrix is an ordinary conductor having a resistance according to Ohm's low, Joule heat is generated in the matrix by a current flowing therethrough), even when the Joule heat is created by substantially entire current supposedly flowing through the matrix, can be promptly removed by the liquid helium contacting the surface of the matrix, so that the wires is maintained below the critical temperature. In addition, a winding system and a cooling system are suitably employed so that film boiling of the liquid helium is not caused on the surface of the matrix. The superconducting coil constructed as described above is referred to as a fully stabilized coil.

The superconducting coil according to the present invention is considered to be an application of the fundamental principle of this fully stabilized coil, which will now be described in more detail.

Figure 9:
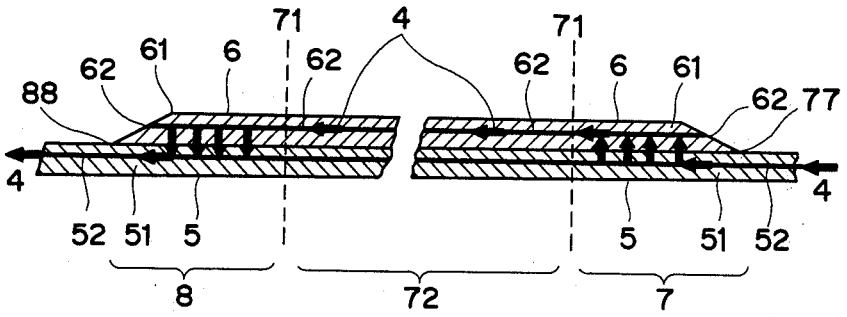
FIG. 9 is an explanatory diagram showing the distribution of the exciting current along the by-pass portion.

It is supposed that the liquid helium 24 is forcedly circulated between the coil windings by the operation of the helium refrigerator 26, and that the exciting current 4 flowing through the coil winding 5 of the magnets 2 disposed in a torus manner, as shown in FIGS. 1 and 2, is uniformly increased to the rated value. In this case, the excessively strong magnetic field is applied to the region 72 as shown in FIGS. 4 and 5. Within the excessively strong magnetic field region 72, the superconductivity of the superconducting wires 52 of the coil winding 5 has been lost. However, the superconductivity of the superconducting wires 62 of the partial by-pass wire 6 is maintained, because the wire 62 is made of a material having a sufficiently high critical magnetic field. FIG. 9 shows the distribution of current flowing through the partial by-pass wire 6 in this case. As is apparent in FIG. 9, within the region 72, the exciting current 4 does not flow through the matrix 51 of the coil winding 5, but the current 4 is transferred in the end portion 7 to the by-pass wire 6 for the use of high magnetic field, and then flows through the superconducting core wires 62 of the by-pass wire 6 within the region 72. Subsequently, the current 4 is again transferred in the end portion 8 to the superconducting core wires 52 of the coil winding 5. This by-passing phenomenon will be clearly understood from the "principle of minimum heat generation" which is well known in electromagnetic theory, teaching that a stationary current in a conductor is distributed so as to minimize the Joule heat. In the above described case, the by-passing distribution of the current 4 in the region 72 is realized because the Joule heat generated by the current 4 passing through contact surfaces 77 and 88 between the matrices 51 and 61 formed in the end portions 7 and 8, respectively, is less than the Joule heat generated by the current 4 flowing in the same region 72 through the matrix 51 of the coil winding 5. Herein, the end portions 7 and 8 must have sufficient lengths (of, for instance, several tens centimeters to several meters; the lengths being determined in accordance with the rated current 4, wire sizes, and the capacity of the refrigerator 26).

In the end portions 7 and 8 of the partial by-pass route, the current 4 flows through the matrices made of ordinary conductive materials and the contacting surfaces between the matrices, and therefore a temperature rise due to Joule heat in the matrices and the heat which is generated in the contacting surfaces by surface resistance is inevitable. According to the present invention, the Joule heat and the other heat are dissipated by transferring the heat from the surfaces of the matrices to the liquid helium, thus maintaining the temperature differences of the coil winding 5 and the partial by-pass wire 6 with respect to the liquid helium lower than 0.1 to 0.3 K. That is, the cooling system of the coil is so designed that the above described temperature differences are sufficiently reduced, and the superconducting characteristics in the superconducting portions of the coil winding 5 and the partial by-pass wire 6 are not deteriorated throughout the entire area of the superconducting coil winding due to the temperature rise.

In the superconducting coil according to the present invention, non-superconductive current flow is effectuated in the end portions 7 and 8 thereby generating Joule heat, while superconductive current flow is effectuated in the remaining part of the coil, so that a magnetic field is generated stably. While the most part of the current flow route is superconductive at the time of the rated operation of the superconducting coil, the current flow route also has a non-superconducting part.

In the combined superconducting coil of the above described construction, the excessively strong magnetic field region 72 is varied between the exciting process of increasing the magnetic field and the stopping process of reducing the magnetic field produced by the coil.

Owing to the variation of the region 72 in the transient state, the interval lengths of the end portions 7 and 8 are also varied. During the time that the magnetic field is weak, the excessively strong magnetic field region 72 does not exist thus causing no by-passing of current through the partial by-pass wire 6.

When the magnetic field is strengthened by increasing the current flowing through the coil, the excessively strong magnetic field region first appears locally in a portion where the maximum magnetic field is applied to the winding, thereby causing the by-pass phenomenon. When the current is further increased, the excessively strong magnetic field region is expanded. If, however, the current is varied slowly and continuously, the distribution of the by-pass current is varied continuously, so that the occurrence of such phenomena as production of high voltage at the by-pass portions or production of excessive eddy current which makes the operation unstable can be prevented.

When the combined superconducting coil according to the present invention is operated, the Joule heat and the other heat is produced as described in the above at both ends 7 and 8 of the by-passes. With this in view, the capacity of the helium refrigerator 26 (FIG. 4) must be larger than that required in the case of purely superconducting coil in order to remove the heat from the coil. However, according to a calculation related to a plasma confining magnet of a practical reactor size or a experimental reactor size nuclear fusion reactor, the increase in capacity of the helium refrigerator 26 used for the combined superconducting coil is substantially equal to or less than that required for removing heat generated by other causes such as heat intrusion through the lead wires, the coil supporting members or the like, and heat generation caused by absorption of leakage neutrons, eddy current caused by plasma heating pulsive magnetic field or the like. This increase can be reduced by some specific design to the order of about one tenth. For this reason, it is clearly understood that the inevitable increase of the refrigeration capacity does not seriously effect upon the construction cost and operational cost of the nuclear fusion reactor.

Concerning the partial by-pass routes, the coil winding 5 may be subjected to a special treatment. Joule heat generated in the partial by-pass routes can be reduced by narrowing the distance between the superconducting core wires 52 and 62 with respect to the surface where the coil winding 5 and the partial by-pass wire 6 contact. Thus, a part of the matrix material between the contacting surface and the core wires may be scraped off so that the core wires 52 and 62 get closer or in a certain case these wires are brought into contact with each other. Such a treatment is advantageous from the view point of saving the refrigeration capacity. In this case, however, a sufficient amount of matrix material must be left around the core wires in order that the function as the fully stabilized coil is not thereby damaged.

The advantageous effects of the present invention will now be described in detail.

In the case of the toroidal magnet for the nuclear fusion reactor, a toroidal magnet having an effective working magnetic field ranging from 7 to 10 T is obtained by using a winding made of economical alloy type superconducting wire material. In this case, the maximum magnetic field applied to the winding is in a range of from 15 to 20 T, and the compound type material such as $Nb_3Sn$ or $V_3Ga$ can be used as the by-pass superconducting core wire relating to the above-mentioned winding. Secondly, the length of the by-pass superconducting wire is equal to or less than one half of the circumferential length of the coil, which is about 30 m at maximum (in the case of a practical nuclear fusion reactor). As a result, there is no necessity of drawing longer strips, wires or coils from the brittle compound type material, so that the superconducting wires are easily manufactured. Thirdly, in conjunction with the above-mentioned second advantageous effect, the shape of the by-pass wire is determined in advance, and therefore the wires of these configurations can be directly manufactured prior to the winding process. Accordingly, it is not necessary to bend the wires further in the by-pass wire connecting process of the winding procedures. It follows that the possibility of cracking or disconnecting the compound type superconducting brittle core wires can be eliminated. Fourthly, corresponding to the above fact that the winding step is not much complicated, the winding can be easily disassembled for the purpose of repair of the winding.

The combined superconducting coil according to the present invention will be compared with the heretofore proposed hybrid type coil wherein compound type wire for high magnetic field is used for an inner part of the coil winding which is exposed to a high magnetic field, and alloy type wire is used for an outer part of the coil winding. From the above described comparison, it is made apparent that in the combined superconducting coil of this invention, the compound type wires for high magnetic field are not used as winding, but are used as partial by-pass wires as described above. Thus, the present invention does not have such a difficulty as found in the manufacturing process of a hybrid coil formed by winding the long strip, wire or coil of the compound type superconductive wire, so that the combined superconducting coil according to the present invention is advantageous over the hybrid type coil. Furthermore, if, in future, a sufficiently economical winding wire is found in the field of compound type superconducting material, the coil wire can be wound by this economical compound type wire, and the partial by-pass wire can be made of one kind of material or two or more than two kinds of materials which have a critical magnetic field higher than that of the abovementioned economical compound type wire, but which have a difficulty in forming long strips, wires or coils. By the above described construction of the coil winding and the partial by-pass wires, the effective working magnetic field can be enhanced further. Particularly, the high magnetic field compound type superconducting materials, such as $Nb_3Sn$, $V_3Ga$, $Nb_3Ge$, $Nb_3Al$, $Nb_3(Al_xGe_{(1-x)})$ or the like, which have been found recently, are said to be extremely brittle and difficult to be wound into a long winding. It is considered, however, that it is not difficult to manufacture the partial by-pass wires from these materials. Furthermore, various methods for producing windings made of compound type superconducting materials, such as a plasma spray method utilizing plasma jet, or a method utilizing electric discharge sputtering, have been studied intensively. Particularly, as a sputtering method, a magnetron sputtering device using crossed magnetic field discharge or the like have been developed or studied in addition to the conventional high frequency sputtering, thereby making it possible to carry out high speed sputter economically. Thus, this sputtering method is applicable to a manufacturing method of compound type superconducting wires. If this method is used for manufacturing the partial by-pass wires of the combined superconducting coil according to the present invention, the advantageous features described in the above can be utilized ingeniously, and the difficulty in manufacturing a long winding wire can be thereby avoided. The compound type superconductive material obtained by the sputtering methods is sometimes found to have better characteristic features than the same material obtained by other methods. Accordingly, if these characteristic features are utilized by the present invention, great merits can be thereby expected.

While the principle, structure, and advantageous effects of the present invention have been described with respect to a case wherein the invention is applied to a toroidal magnet used in a nuclear fusion reactor, it is apparent that various modifications and alternations can be worked out of the invention by those skilled in the art. For instance, the invention is applicable to an extremely large size magnet used for storing electric power, or to a "saddle" type magnet for magnetohydrodynamic (MHD) power generator. In some cases, the invention can be further applied to a special shape magnet in a magnetic separation device wherein a gradient of the magnetic field is required to be very steep.

While in the above embodiment, explanation has been made only in the case of the circular coil, the present invention is not limited to this shape, but a non-circular coil such as a D-shaped coil which is suitable for reducing bending moment applied to the winding may also be employed.

While a cooling system wherein the coil winding is completely dipped in liquid helium has been described hereinabove, it will be apparent that other types of cooling system utilizing, for instance, supercritical helium may also be used for the same purpose.

The present invention is applicable not only to the provision of partial by-pass routes along parts of the coil winding which is exposed to an excessively strong magnetic field, but also to the provision of partial by-pass wires along parts of the coil winding where the current is easily susceptible to external disturbances and superconducting state becomes unstable, for the purpose of stabilizing and reinforcing these parts. Furthermore, the present invention is also applicable to a process of winding a coil or providing by-pass wires in the case of a manufacture of a coil having a complicated configuration, wherein a coil winding is once cut into pieces for the convenience of the coil winding operation and then by-pass wires are provided as mentioned in the above to ensure current flow paths for the disconnected portions in a manner the Joule heat generated in the disconnected positions is removed and the superconduction of the other winding portions is maintained in stable.

What I claim is:

1. A combined superconducting coil comprising:

a coil winding formed by a first composite superconducting wire of fully stabilized type having core wires of a first kind of superconducting material, for generating a strong magnetic field exceeding a critical value in at least one part of respective turns in at least one part of said coil winding when an exciting current is applied to said coil winding, a plurality of partial by-pass wires formed by a second composite superconducting wire of fully stabilized type having core wires of a second kind of superconducting material, said partial by-pass wires being arranged along and in contact with said coil winding so that said plurality of partial by-pass wires form by-passes for said exciting current along portions of said coil winding where said strong magnetic field exceeds the critical value, the length of said partial by-pass wire being so selected that both ends of said partial by-pass wire extend beyond said portions of said coil winding, and said partial by-pass wire having such a high critical magnetic field as maintaining superconductivity even in said magnetic field exceeding the critical value of the first kind of superconducting material, and a plurality of flow passages for circulating extremely low temperature helium between respective turns of said coil winding so that said extremely low temperature helium is in direct contact with at least one surface of at least one of said coil winding and said partial by-pass wires, whereby heat generated in the vicinity of said both ends of said partial by-pass wires is promptly dissipated in said extremely low temperature helium.

2. A combined superconducting coil as claimed in claim 1, wherein said first kind of superconducting material is alloy type superconducting material and said core wires of said coil winding are embedded in a matrix of normal conducting material.

3. A combined superconducting coil as claimed in claim 1, wherein said second kind of superconducting material is compound type superconducting material and said core wires of said partial by-pass wires are embedded in a matrix of normal conducting material.

4. A combined superconducting coil as claimed in claim 2, wherein said second kind of superconducting material is compound type superconducting material and said core wires of said partial by-pass wires are embedded in a matrix of normal conducting material.

5. A combined superconducting coil as claimed in claim 2, wherein said alloy type superconducting material is niobium-titanium alloy and said matrix of normal conducting material is copper or aluminum.

6. A combined superconducting coil as claimed in claim 3, wherein said compound type superconducting material is selected from the group consisting of $Nb_3Sn$, $V_3Ga$, $Nb_3Ge$, $Nb_3Al$, $Nb_3(Al_xGe_{(1-x)})$ and said normal conducting material is copper or aluminum.

7. A combined superconducting coil as claimed in claim 4, wherein said alloy type superconducting material is niobium-titanium and said compound type superconducting material is selected from the group consisting of $Nb_3Sn$, $V_3Ga$, $Nb_3Ge$, $Nb_3Al$, $Nb_3(Al_xGe_{(1-x)})$ and said normal conducting material is copper or aluminum.

8. A combined superconducting coil as claimed in claim 1, wherein said extremely low temperature helium is selected from the group consisting of liquid helium or super-critical helium.

9. A combined superconducting coil as claimed in claim 1, wherein spacers are inserted between said respective turns of said coil winding to form said flow passages, respectively.

10. A combined superconducting coil as claimed in claim 1, wherein said by-pass wires are in tight contact with said coil winding.

11. A combined superconducting coil as claimed in claim 1, wherein said by-pass wires are soldered to said coil winding.

12. A combined superconducting coil as claimed in claim 1, wherein said by-pass wires are bonded to said coil winding by an intermediary of electrically conductive material.

13. A combined superconducting coil as claimed in claim 1, wherein the distance between said core wires of said coil winding and said partial by-pass wire is reduced by reducing the thickness of the matrices of said coil winding and said partial by-pass wire between said core wires.

14. A combined superconducting coil as claimed in claim 13, wherein at least one part of said core wire of said coil winding is in contact with at least one part of said core wire of said partial by-pass wire.

15. A combined superconducting coil as claimed in claim 1, wherein said core wires of said partial by-pass wire are in the form of thin strips embedded in said matrix.

16. A combined superconducting coil as claimed in claim 1, wherein said core wires of said partial by-pass wire are in the form of thin films adhered onto the surface of said matrix.

* * * * *